US006306353B2

(12) United States Patent
Freeman et al.

(10) Patent No.: US 6,306,353 B2
(45) Date of Patent: Oct. 23, 2001

(54) DECORATIVE CANDLE AND METHOD OF MANUFACTURING THE SAME

(75) Inventors: Faith Freeman, Huntington Beach; Frank H. Asbury, Anaheim; Leon J. Savoit, IV, La Habra, all of CA (US)

(73) Assignee: Primal Elements, Inc., Garden Grove, CA (US)

( * ) Notice: Subject to any disclaimer, the term of this patent is extended or adjusted under 35 U.S.C. 154(b) by 0 days.

(21) Appl. No.: 09/804,515

(22) Filed: Mar. 12, 2001

Related U.S. Application Data

(63) Continuation-in-part of application No. 09/245,098, filed on Feb. 8, 1999, now Pat. No. 6,214,295.

(51) Int. Cl.[7] ..... F23D 3/16

(52) U.S. Cl. ..... 422/126; 44/275; 44/530; 44/600; 431/288; D26/6

(58) Field of Search ..... 422/126, 5; 44/275, 44/530, 600; 431/288; D26/6

(56) References Cited

U.S. PATENT DOCUMENTS 3,797,990 * 3/1974 Rogers et al. ..... 431/288 X
4,568,270 * 2/1986 Marcus et al. ..... 431/288
4,917,597 * 4/1990 Henze ..... 431/288 X
5,338,187 * 8/1994 Elharar ..... 431/288
6,068,472 * 5/2000 Freeman et al. ..... 431/291
6,079,975 * 6/2000 Conover ..... 431/288
6,096,102 * 8/2000 Matthai et al. ..... 44/275
6,129,771 * 10/2000 Ficke et al. ..... 44/275
6,171,102 * 1/2001 Freeman et al. ..... 431/291
6,214,295 * 4/2001 Freeman ..... 422/126

* cited by examiner

*Primary Examiner*—Elizabeth McKane
(74) *Attorney, Agent, or Firm*—Stetina Brunda Garred & Brucker

(57) ABSTRACT

A decorative candle and method of forming a decorative candle are disclosed. The decorative candle is fabricated from a wax material that defines a bottom layer having a top surface. At least one flanged gelatinous component formed from a mineral oil gel is placed onto the top surface of the bottom layer. A second layer of wax having a top layer is added such that the entire flange portion of the gelatinous component is covered, but at least a portion of the decorative (non-flange) portion of the gelatinous component protrudes above the top surface of the top layer of the candle.

21 Claims, 3 Drawing Sheets

DECORATIVE CANDLE AND METHOD OF MANUFACTURING THE SAME

CROSS-REFERENCE TO RELATED APPLICATIONS

This is a continuation-in part of application Ser. No. 09/245,098 filed Feb. 8, 1999 now U.S. Pat. No. 6,214,295.

STATEMENT RE: FEDERALLY SPONSORED RESEARCH/DEVELOPMENT (Not Applicable)

BACKGROUND OF THE INVENTION

The present invention generally relates to decorative candles and more particularly to a decorative candle including uniquely shaped, integral flanged gel components.

Candles have become popular for decorative purposes and as such are being formed in different styles, shapes, and colors. Additionally, scented candles are gaining popularity for their perceived therapeutic value in aromatherapy. Typically, there are three different types of candles: tapered, molded and container. The candles may be manufactured from a wax such as paraffin, vegetable, or beeswax.

A container candle is formed by pouring melted wax into a container having a wick disposed therein. The wick is extensible through the wax such that as the wick is burned, the wax around the wick will melt thereby providing fuel for the wick to burn. A molded candle is formed by pouring melted wax into a mold containing a wick. The wax is allowed to cool such that it solidifies and is then removable from the mold thereby forming the candle. Tapered candles are formed by dipping a wick into melted wax. Each time the candle is dipped into the melted wax, the wax adheres to itself thereby forming the tapered candle.

Different types of paraffin waxes may be used for different types of candles. For instance, candles made in a container may be formed from container wax. This wax has a relatively high oil content and a relatively low melting point of between about 125° F. and 138° F. or lower. The relatively high oil content of this type of wax allows for a long burning candle. Mold wax which has a melting point between 139° F. and 143° F. is used for molded candles because the wax does not contain much oil and therefore can retain its form after removal from the mold. Tapered candles are formed from dipping wax which typically has a melting point of around 145° F. The high melting temperature allows the wax to adhere to itself as it is being dipped thereby forming a tapered candle.

Additionally, pigments and/or fragrances can be added to the wax to give the candle a unique appearance and/or scent. Typically, the fragrance and/or pigment is mixed with the wax when in a melted state. The wax containing the fragrance and/or pigment is then formed into the preferred type of candle. The pigment will give the candle a desired coloring while the fragrance gives the candle a preferred scent. The scent produced by the fragrance may become more pronounced as the candle and therefore the fragrance are being burned.

In addition to making candles out of wax, mineral oil has been used to make candles (e.g., gel candles). The mineral oil is gelatinous at room temperature such that it can generally retain its form unsupported. Typically, a gel candle is formed by pouring melted mineral oil into a container having a wick. The mineral oil is allowed to cool to its gelatinous state thereby forming a candle within the container. Gel candles burn longer than candles made from paraffin wax because of the high oil content of the gel. As with traditional paraffin wax candles, gel candles may additionally be scented and/or colored to add more variety.

The present applicant has previously originated and developed a unique candle which is a combination of paraffin wax and gelatinous mineral oil components. Such a combination is disclosed in U.S. patent application Ser. No. 09/245,098 filed on Feb. 8, 1999, the disclosure of which is expressly incorporated herein by reference. The novel candle described in U.S. patent application Ser. No. 09/245,098 has gained widespread acceptance for its aesthetic value. However, over time the gelatinous mineral oil components of the candle described in U.S. patent application Ser. No. 09/245,098 may migrate during transport or when heated.

The present invention comprises a candle fabricated from paraffin wax and gelatinous mineral oil components as well as an improved method of forming such candle by way of using one or more pre-formed flanged gelatinous mineral oil components. The components are used as a decorative element that additionally allow the candle to burn longer. Therefore, the candle of the present invention has a distinctive decorative style and burns longer than traditional wax candles. Non-flanged gelatinous components may migrate or dislodge during transport or when heated. The flanged configuration of the gelatinous components ensures that the gelatinous components will be held securely in place.

BRIEF SUMMARY OF THE INVENTION

In accordance with the preferred embodiment of the present invention, there is provided a method of manufacturing a decorative candle comprising the step of providing a candle fabricated from a wax material (e.g., paraffin wax) which defines a bottom (support) layer having a top surface. At least one flanged gelatinous component is placed onto the top surface of the bottom layer. A top layer of wax material is placed on top of the bottom layer of wax material such that the flange portion of the component is completely covered with the wax material while the top, decorative (non-flange) portion of the component protrudes above the top surface of the top layer of the wax material.

The candle may be fabricated by first providing a container and placing a wick therein. Next, a quantity of wax is melted and poured into the container. The wax is allowed to cool until it hardens into the candle. A pigment and/or a fragrance may be added to the wax while it is in a molten state in order to give the wax a desired color and/or scent. Alternatively, a pre-formed candle or puck may be inserted into the container.

The flanged gelatinous component may be fabricated by melting a quantity of a mineral oil gel and then forming the molten gel using a mold with a cavity formed in the shape of the desired flanged component. While the gel is molten, a pigment and/or a fragrance may be added to the gel to produce a desired color and/or scent. Alternatively, the flanged gelatinous components may be fabricated using a die cut process in which a layer of gelatinous material is compressed prior to cutting the gelatinous component. The component decompresses after the component is cut out of the layer of gelatinous material.

The above mentioned steps produce a decorative candle comprising a container having an open end and a quantity of wax disposed therein. The wax has a top surface that is adjacent to the open end of the container. The candle additionally comprises a wick disposed within the wax and protruding upwardly from the top surface, and at least one flanged gelatinous component partially disposed within the top surface of the wax, wherein the flanged portion of the gelatinous component is completely covered by the wax. Although not by way of limitation, the wick may protrude through a flanged gelatinous component when the gelatinous component lies above as opposed to adjacent the wick. Typically, the wax will be a paraffin based wax and the flanged gelatinous component will be formed from mineral oil gel. Both the wax and the gel component may comprise a pigment and/or a fragrance. The container may be a metallic container or a glass container.

BRIEF DESCRIPTION OF THE DRAWINGS

These as well as other features of the present invention will become more apparent upon reference to the drawings wherein.

DETAILED DESCRIPTION OF THE INVENTION

Figure 1:
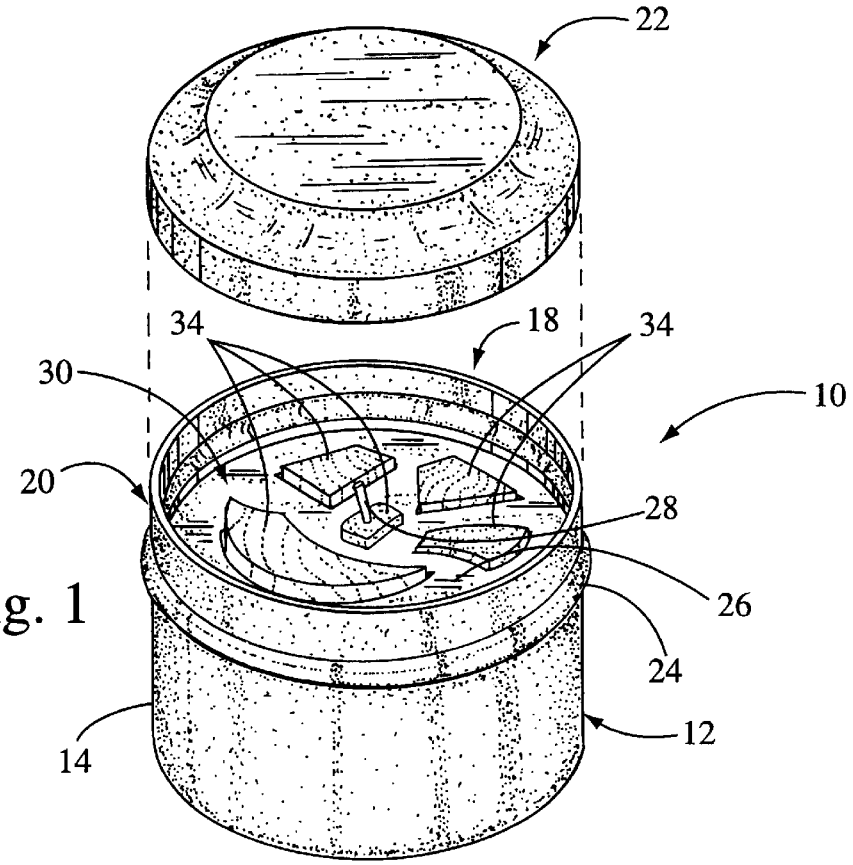
FIG. 1 is a top perspective view of the decorative candle fabricated in accordance with the preferred embodiment of the present invention.

Referring now to the drawings wherein the showings are for purposes of illustrating a preferred embodiment of the present invention only, and not for purposes of limiting the same, FIG. 1 is a perspective view of a wax and gel candle 10 manufactured in accordance with the preferred method of the present invention. The candle 10 comprises a container 12 preferably formed of a non-combustible material such as from a metallic or glass material. Although not by way of limitation, the container 12 may be formed having a generally cylindrical configuration such that it comprises a side wall 14 having a generally circular configuration that extends perpendicularly from a circular bottom wall 16. The side wall 14 and the bottom wall 16 define an enclosable interior compartment 17 and an open end 18 formed about a top portion 20. The container 12 preferably includes a lid 22 with a generally circular cross-sectional configuration used to cover and extinguish the candle 10. The diameter of lid 22 is sized slightly larger than the diameter of the circularly configured side wall 14. Therefore, as seen in FIG. 1, the lid is placeable over open end 18 of container 12 to extinguish any flame of candle 10. The container 12 is provided with a lip 24 disposed about the exterior surface of the side wall 14. The lip 24 is placed about the top portion 20 of container 12 such that lid 22 makes abutting contact with lip 24 when placed over open end 18.

Figure 7:
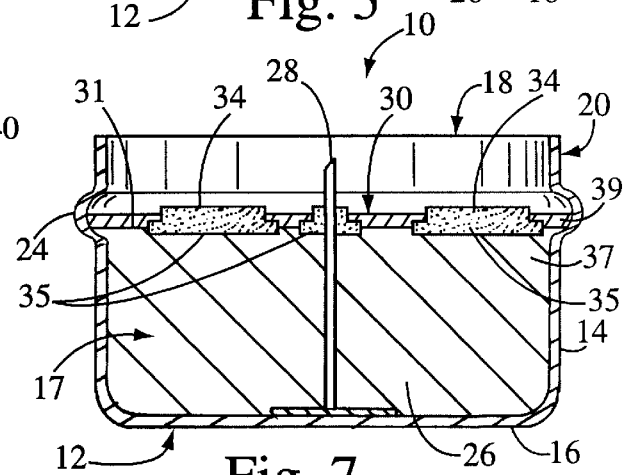
FIG. 7 is a cross sectional view of the bottom and top layers of the candle shown in FIG. 1.

Disposed within the candle 12 is a prescribed volume of wax 26 and a wick 28 typically made from woven cotton or linen thread. The prescribed volume of wax 26 is made up of a bottom layer 37 and a top layer 39 as shown in FIG. 7 and described later. It is contemplated that the preferred wax 26 is a food grade paraffin wax with a melting point of between about 125° F. to about 145° F. The wax may be mixed with a Food, Drug and Cosmetics (FD&C) ornamental pigment or dye to make the wax a desired color. Additionally, a fragrance such as an oil may be mixed with the wax to provide an aroma or scent as the candle 10 is burned. As shown in FIG. 7, the wick 28 protrudes upwardly from an upper surface 30 of the top layer 39 of wax 26. The upper surface of wax 26 (both the bottom layer 37 and the top layer 39) is formed such that it extends in generally parallel relation to bottom 16. Additionally, the wick 28 is positioned within wax 26 such that it extends from bottom 16 to the approximate center of the top surface 30 of the top layer 39.

Placed into the wax 26 at top surface 31 of bottom layer 37 are one or more gelatinous components 34. The components 34 are formed from a gelatinous mineral oil that has a melting point higher than the wax 26 and is used in the manufacturing of conventional gel candles. The mineral oil gel is solid, yet flexible and capable of generally retaining its shape at ambient temperature. Additionally, pigments and/or fragrances may be mixed with the gel in order to provide a desired color and/or scent. Examples of such mineral oil gels are "Candle Gel" and "Versa Gel" both of which are manufactured by Penrico of Woodlands, Tex.

As seen in FIG. 1, the gelatinous components 34 can be configured into decorative designs and shapes that adorn the top surface 30 of wax 26. The components 34 are affixed into the wax 26 about ⅛" below the top surface 30 by a method that will be further explained below. For decorative purposes, it is preferable that the gelatinous components 34 have a height that is greater than the depth that they are inserted into the wax 26 such that a portion of each component 34 protrudes above top surface 30. The heat produced by a flame burning wick 28 of candle 10 melts the wax 26 and the gelatinous components 34. The components 34 provide mineral oil which is used by the flame on wick 28 as an additional fuel rather than just wax 26. Therefore, the wick 28 will not only burn candle wax 26, but also the mineral oil from gelatinous components 34, thereby prolonging the life of candle 10.

Figure 2:
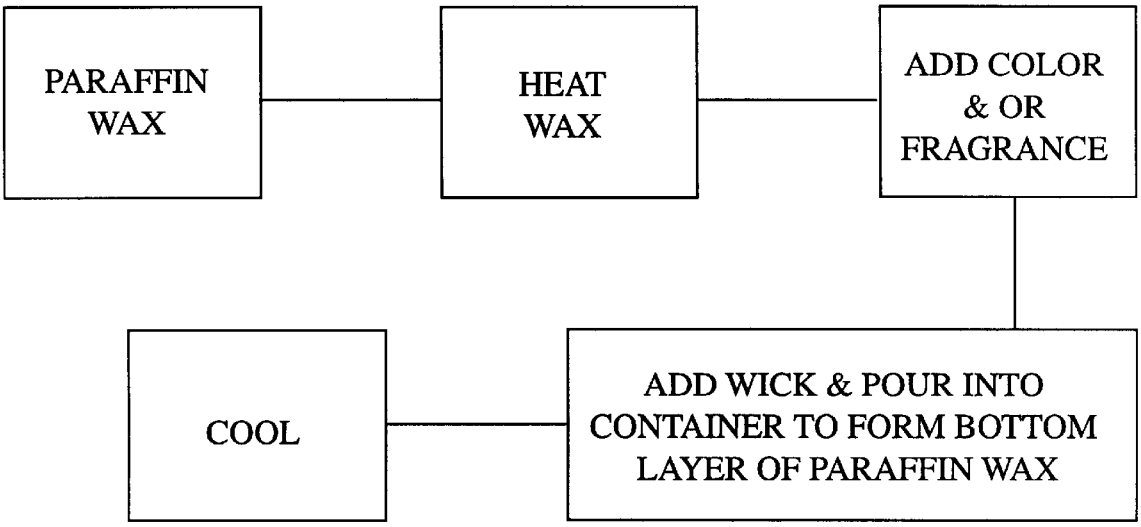
FIG. 2 is a block diagram showing the steps involved in forming the wax portion of the bottom layer of the candle shown in FIG. 1.

With reference to FIG. 2, the preferred method of manufacturing the decorative candle 10 is to first provide a prescribed quantity of food grade paraffin wax 26 that will be used in container 12 of candle 10. Next, the wax 26 is heated such as via an induction or flame method to a temperature at which the wax 26 melts into a liquid solution (i.e., about 125° F. to about 145° F.). At this point, while the wax 26 is molten, the desired fragrance and/or pigment may be mixed with the wax 26. The wick 28 is placed within container 12 and positioned as previously described above. The wax 26 is then poured through the open end 18 of container 12 into interior compartment 17 to form a bottom layer 37 of paraffin wax and then allowed to cool until it solidifies. Alternatively, a pre-formed paraffin wax puck can be positioned into the container to be used as the bottom layer 37 of paraffin wax.

Figure 3:
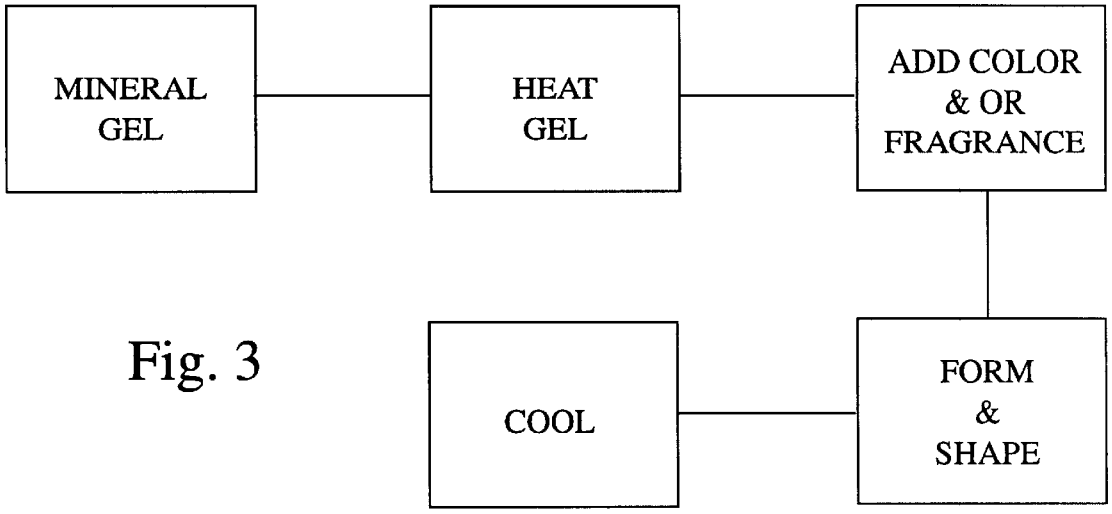
FIG. 3 is a block diagram showing the steps involved in forming the gel portion of the candle shown in FIG. 1.
Figure 4:
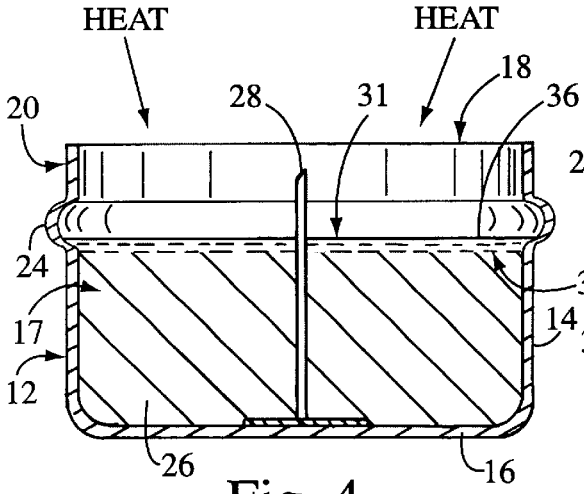
FIG. 4 is a cross-sectional view showing the wax portion of the candle shown in FIG. 1 formed in accordance with the steps shown in FIG. 2.
Figure 6:
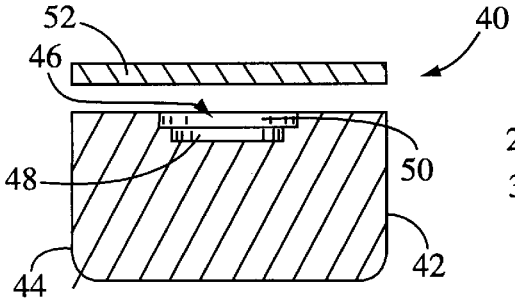
FIG. 6 is a perspective view of a mold for forming the flanged gel components of the candle shown in FIG. 1.

With reference to FIG. 3, the gelatinous components 34 are formed by providing a prescribed quantity of the mineral oil gel previously described above. The mineral oil gel is heated via an induction or flame method until the gel melts into a liquid. Then a desired color and/or fragrance may optionally be mixed with the gel. The flanged gelatinous components 34 may be formed using a mold such as the one shown in FIG. 6. The mold 40 shown in FIG. 6 includes a mold cavity component 42 and a mold core component 52. The mold cavity component 42 has a base portion 44 and a cutout portion 46. The cutout portion 46 includes a component cutout portion 48 and a flange cutout portion 50. Molten gel is poured into the cutout portion 46. The mold core component 52 and the mold cavity component 42 may be separate pieces as shown in FIG. 6 or may be attached, e.g., using a hinge. The bottom of the mold core component 52 is a flat surface and is used to form the bottom surface of the flange portion of the flanged gelatinous components 34.

Figure 5:
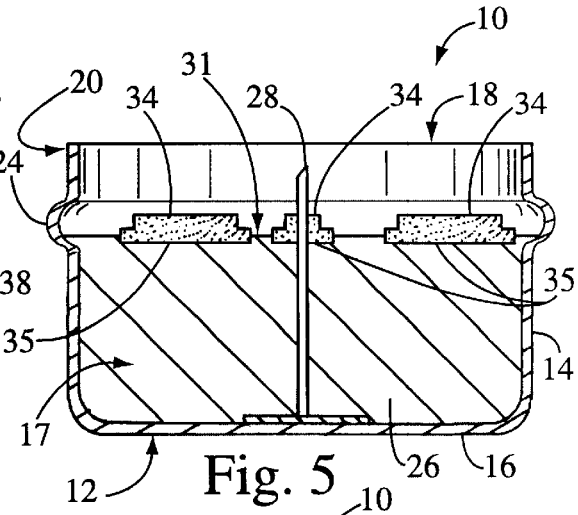
FIG. 5 is a cross-sectional view of the bottom layer of the candle shown in FIG. 1.

After the gel has sufficiently cooled, the flanged component(s) 34 are removed from the mold 40, inverted and placed on the top surface 31 of the bottom layer of wax 37 at a desired location(s). As shown in FIG. 5, the shape of the gelatinous components 34 includes a flange 35 or anchor bottom portion which holds the gelatinous components 34 securely in the wax 26. As will become more apparent infra, the flange 35 helps to ensure that the gelatinous components 34 will not become dislodged during shipping and handling. If desired, a gelatinous component 34 may be pushed onto wick 28 such that the wick penetrates the component as shown in FIG. 7.

Figure 8:
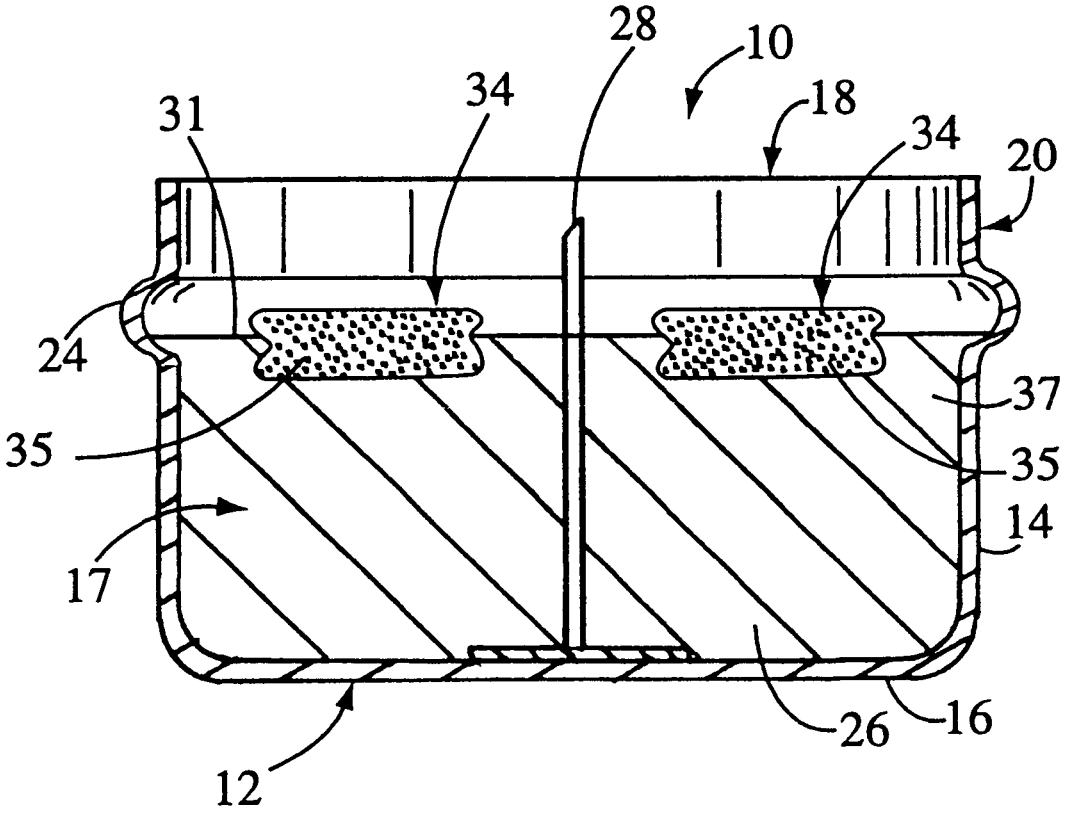
FIG. 8 is a cross sectional view of the bottom and top layers of an alternative decorative candle wherein the components are formed using a die cut process.

In an alternative embodiment, the gel components 34 are die cut. The liquid gel is poured into a suitable container such that a sheet of gel that is the desired depth of the component(s) may be formed. The gel is cooled and the cooled gelatin layer is compressed, for example, between two metal plates. The compressed gel is then die cut into the desired shape of the component(s) 34. The components 34 are removed from the die and allowed to de-compress. The edges (periphery) of the components 34 become hourglass shaped when the gel decompresses, as shown in FIG. 8. As can be seen in FIG. 8, the hourglass shaped components 34 have a flange-like bottom that allows for the physical capture of the components 34 between pours.

After the components 34 are positioned, another layer of paraffin wax prepared as described above is placed over the bottom layer of paraffin wax 37 containing the flanged gelatinous components so that the flange portions 35 of the gelatinous components 34 are covered, while at least a portion of the upper decorative (non-flange) portion of the component protrudes above the top surface 30, as shown in FIG. 7. This maintains the desired aesthetic appearance of the candle while ensuring that the gelatinous components 34 are held securely in place because the wax captures the flange between wax pours and eliminates gel migration and/or lift out during shipping and handling.

Additional modifications and improvements of the present invention may also be apparent to those of ordinary skill in the art. For example, the configuration of container 12 and/or the shape of components 34 may be varied. Thus, the particular combination of parts described and illustrated herein is intended to represent only certain embodiments of the present invention and is not intended to serve as limitations of alternative devices within the spirit and scope of the invention.

What is claimed is:

1. A method of manufacturing a decorative candle comprising the steps of:

a) providing a candle which is fabricated from a wax material and defines a bottom layer having a top surface;

b) placing at least one flanged gelatinous component having a lower flange portion and an upper decorative portion onto the top surface of the bottom layer; and c) placing a top layer of the wax material on top of the top surface of the bottom layer of the wax material forming a top layer having a top surface such that the lower flange portion of the component is completely covered while at least a portion of the upper decorative portion of the component protrudes above the top surface of the top layer of the wax material.

2. The method of claim 1 wherein step (a) comprises providing a pre-formed candle which is fabricated from a paraffin wax material.

3. The method of claim 1 wherein step (a) comprises:

i) providing a container;

ii) placing a wick within the container;

iii) melting a quantity of wax;

iv) pouring the molten wax into the container; and v) cooling the molten wax until it hardens into the candle.

4. The method of claim 3, wherein the wick penetrates through at least one flanged gelatinous component.

5. The method of claim 3 wherein step (a)(iii) further comprises adding a pigment to the molten wax.

6. The method of claim 3 wherein step (a)(iii) further comprises adding a fragrance to the molten wax.

7. The method of claim 1 wherein step (b) comprises:

i) providing a quantity of mineral oil gel;

ii) melting the mineral oil gel; and iii) forming the melted mineral oil gel into the at least one flanged gelatinous component.

8. The method of claim 7 wherein step (b)(ii) further comprises adding a pigment to the molten mineral oil gel.

9. The method of claim 7 wherein step (b)(ii) further comprises adding a fragrance to the molten mineral gel.

10. The method of claim 7 wherein step (b)(iii) comprises:

(1) providing a mold having a cavity with a cutout shape having a flange portion;

(2) pouring the melted mineral oil gel into the cutout shape of the mold cavity;

(3) allowing the gel to solidify in the mold;

(4) removing the gel shape from the mold; and (5) inverting the gel shape.

11. The method of claim 7 wherein step (b)(iii) comprises:

(1) the first element forming a layer of melted mineral oil gel;

(2) allowing the layer of gel to solidify;

(3) compressing the solidified layer of gel;

(4) cutting a gel shape in the layer of solidified gel; and (5) allowing the gel shape to decompress.

12. A decorative candle comprising:

a container having an open end;

a quantity of wax disposed within the container and having a top surface disposed adjacent to the open end;

a wick disposed within the wax and protruding upwardly from the top surface; and at least one flanged gelatinous component partially disposed within the top surface of the wax.

13. The decorative candle of claim 12 wherein the wax comprises paraffin wax.

14. The decorative candle of claim 12 wherein the wax comprises a pigment.

15. The decorative candle of claim 12 wherein the wax comprises a fragrance.

16. The decorative candle of claim 12 wherein the gelatinous component is formed from a mineral oil gel.

17. The decorative candle of claim 16 wherein the mineral oil gel comprises a pigment.

18. The decorative candle of claim 16 wherein the mineral oil gel comprises a fragrance.

19. The decorative candle of claim 12 wherein the container is a metallic container.

20. The decorative candle of claim 12 wherein the container is a glass container.

21. The decorative candle of claim 12 wherein the wick penetrates one of the flanged gelatinous components.

* * * * *